United States Patent [19]

Hanus

[11] Patent Number: 4,850,528

[45] Date of Patent: Jul. 25, 1989

[54] SELF-LOCKING CONTAINER CLOSURE

[76] Inventor: John P. Hanus, 3509 N. 64th St., Milwaukee, Wis. 53216

[21] Appl. No.: 11,094

[22] Filed: Feb. 5, 1987

[51] Int. Cl.[4] ..... B65D 5/36

[52] U.S. Cl. ..... 229/138; 229/108; 229/155; 229/41 C

[58] Field of Search ..... 229/108, 138, 155, 41 C, 229/4.5, 117, 173, 183, 184, 185

[56] References Cited

U.S. PATENT DOCUMENTS

| | | | |
|---|---|---|---|
| 2,047,804 | 7/1936 | Shapiro | 229/138 |
| 2,091,291 | 8/1937 | Ringler | 229/138 |
| 3,232,480 | 2/1966 | Stanley | 229/138 |
| 3,253,767 | 5/1966 | Pellaton | 229/108 |
| 3,549,081 | 12/1970 | Nelson | 229/138 |
| 3,768,720 | 10/1973 | Bundy | 229/138 |

FOREIGN PATENT DOCUMENTS

| | | | |
|---|---|---|---|
| 2648983 | 5/1978 | Fed. Rep. of Germany | 229/41 C |
| 1193505 | 11/1959 | France | 229/41 C |
| 505526 | 5/1939 | United Kingdom | 229/41 C |

*Primary Examiner*—Willis Little

*Attorney, Agent, or Firm*—Foley & Lardner

[57] ABSTRACT

A container with integral self-closing and self-locking foldable closure material above the container rim which is pleated with alternating internal and external folds. The geometry of the folds creates a spring action to the pleated folds as the top is folded which will 'lock' resiliently in place when they are pushed beyond the rim of the container and will remain so, whether or not the panels are designed to meet in the center to completely close the container or are designed to leave a center opening when locked. While the container is closed a rod or tube may be inserted in any of the disclosed forms without opening or unlocking the closure.

9 Claims, 8 Drawing Sheets

SELF-LOCKING CONTAINER CLOSURE

BACKGROUND OF THE INVENTION

The present invention pertains to paper containers such as paper cups and the like. Many such containers are known, including U.S. Pat. No. 3,713,576 (Goebel); U.S. Pat. No. 2,160,488 (Ringler); U.S. Pat. No. 2,014,477 (Lee); U.S. Pat. No. 1,504,365 (Geist); U.S. Pat. No. 1,867,914 (Geist); U.S. Pat. No. 1,446,014 (Lodge); U.S. Pat. No. 1,218,723 (Vavra); U.S. Pat. No. 648,448 (Wagnitz); and U.S. Pat. No. 714,320 (McBride). The principle feature of most of the prior art containers is that they may be flat when shipped and subsequently made into containers. None of the prior art containers of this type, which include a top or a part thereof, are designed to self-close and self seal in the manner of my

SUMMARY OF THE INVENTION

The present invention provides a self-sealing container, in which the top or the walls and top can be made from a single blank of flexibly stiff paper or thin cardboard or other similar foldable material. If a body section is included it is flexed and glued or bonded to form the side walls of the container and features a top section having numerous creases or folds which forms the top of the container. The body section is preferably cylindrical but may be polygonal or conical. The bottom is preferably a conventional cup bottom, but may have other shapes.

The top of the container is the portion to which various aspects of a preferred embodiment of the invention relate. The creases or folds in the top section define alternating generally triangular tucked panels and generally quadrilateral exposed panels extending between alternating external folds and internal folds. An external fold is convex when viewed from outside the cup. An internal fold is concave. The edges of these panels which are uppermost when the container is open may be described as "falling" or "rising" in the preferred form. The tucked panels have falling top edges, that is, they decrease in height from the container rim in a direction from the external fold to the internal fold. The quadrilateral exposed panels have a rising top edge from the internal fold to the external fold. The number of the internal and external folds used is determined primarily by the number of panels chosen for the top of the closed container.

When the top section of the container is gently pushed downward and twisted in a single motion, the tucked panels fold under the exposed panels, the exposed panels overlapping in a shingle-like manner, and a small rosette is formed at the center of the top of the container where the exposed panels contact and overlap one another. Because of the sizes and shapes of the respective exposed panels and tucked panels, when the top section of the container is pushed downward, the top panels are put under compression and the tucked panels are put under tension. When these panels are pushed beneath the plane of the rim of the container, the forces of compression and tension pull downward with respect to the plane of the rim to 'lock' the top of the container. The overlap of the panels at the "rosette" limits the downward movement before the tension and compression are relieved. The exposed panels press against one another sufficiently to form a seal in the versions in which they meet at the center or, in an alternate preferred embodiment, at a tube inserted at the center. The resilience of the panels forming the rosette allows a drinking straw or other tube of predetermined desired stiffness to be inserted into the container at the center. The exposed panels will displace downward upon such insertion and will create a seal around the straw or tube. A special opening in the top for a straw or tube may be provided.

An alternative preferred embodiment of the present invention comtemplates an opening in the center of the top of the container, formed by modifying the free outer edges of the quadrilateral exposed and triangular tucked panels. Any combination of shapes of these 'free edges' are possible as dictated by the application.

The self sealing container of the present invention is inexpensive to produce and easy to use. Since it provides a container for which a separate cover or lid is not necessary, it is also economical for the user. Additionally, the present invention provides the container with a tight seal into which a straw or tube may be inserted without disrupting the seal.

These and other benefits of the present invention will be described in conjunction with the appended drawings, wherein like designations denote like elements.

BRIEF DESCRIPTIONS OF THE DRAWINGS

DETAILED DESCRIPTION OF PREFERRED EXEMPLARY EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto. every showing the conventional bottom of each container It is understood that a variety of bottom configurations may be used in conjunction with the illustrated embodiments.

Figure 2:
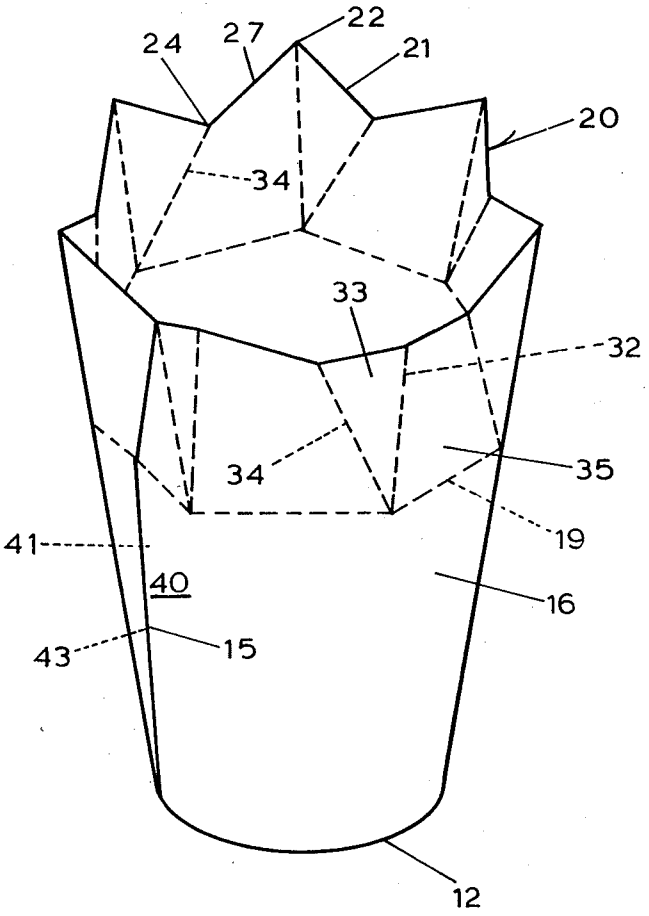
FIG. 2 shows the container shown of FIG. 1 the assembled unclosed and unlocked condition.
Figure 1:
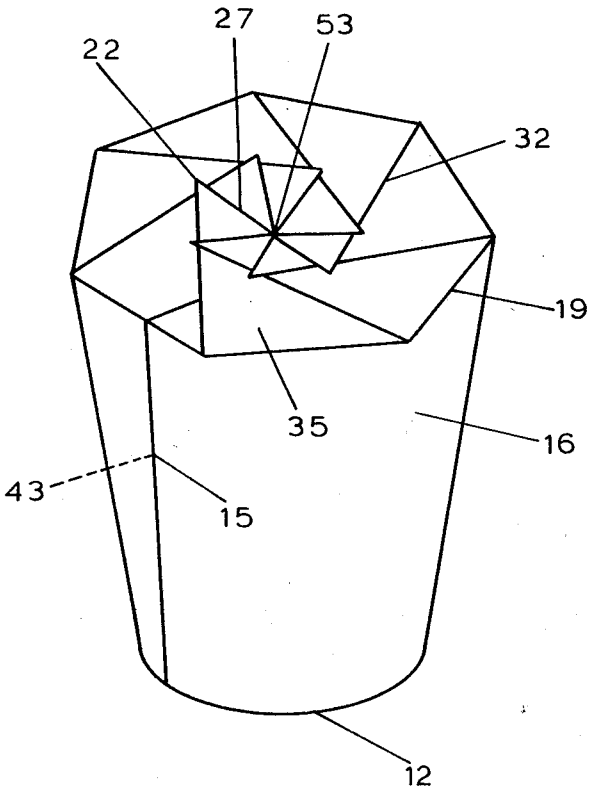
FIG. 1 shows the self-locking container of the present invention with the top folded downwardly and locked in place.
Figure 3:
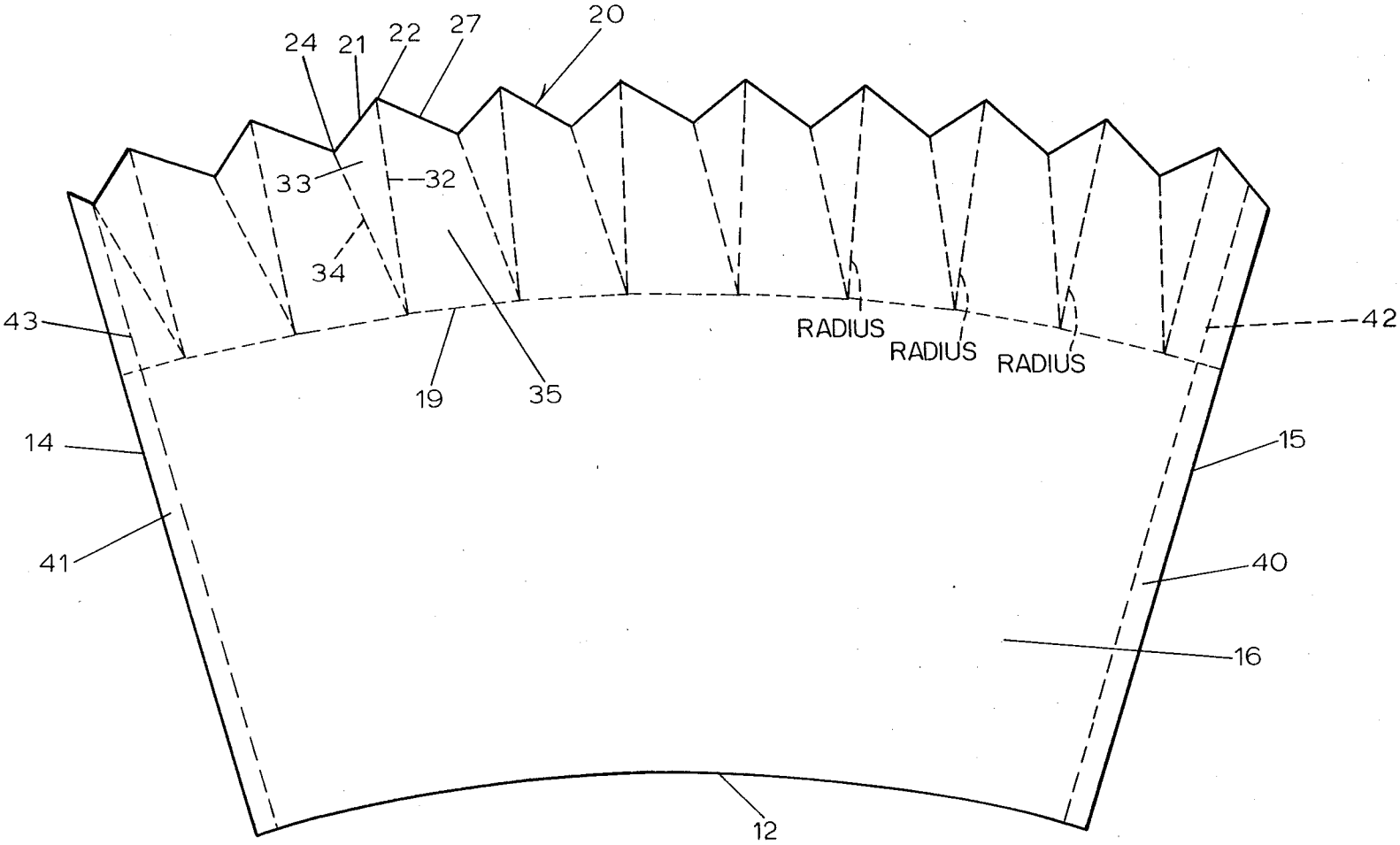
FIG. 3 is a plan view of a blank for forming a self-locking container in accordance with the present invention.

The self-sealing container of the present invention is generally denoted by the number 16. The preferred form is shown in its assembled and locked state in FIG. 1. The container 16 is made of a flexibly stiff paper or thin cardboard or other similar foldable material. If appropriate for a particular use the material may be waxed. The design for the blank shown in FIG. 3, which is the pattern for the sides and top of container in FIG. 1 (not drawn to exact scale), is used in a container which requires draft for economical storage, and has a free edge 20 which is one of many which could be used. The container shown is the common truncated cone, but within my invention other blanks may be used to form a cylinder, box, or polygon shaped container. We will refer to FIG. 3 for ease of description. The blank 16 is generally arc shaped having a smooth bottom edge 12, a serrated top edge 20, and straight sides 14 and 15 which are extended radii of the circle which would be formed by the extension of the arc of the bottom edge 12. Dotted line 19 becomes the rim of the container 16 when the portion of the bottom edge 12 to the rim 19 will be flexed to form a circle to form the walls of the container 16 while the portion from the rim 19 to the top edge 20 will form the top of the container. External folds 32 formed at the top of the container 16 extend from point 22 on line 20 down to the rim 19 and have their apex toward what will be the outside of the container 16. In the blank shown the external folds 32 are also the extended radii of the circle which would be formed by the extension of the arc of the bottom edge 12 of the container 16. They lie in the plane of the axis of the container 16 when the blank is assembled into a circle.

Figure 12:
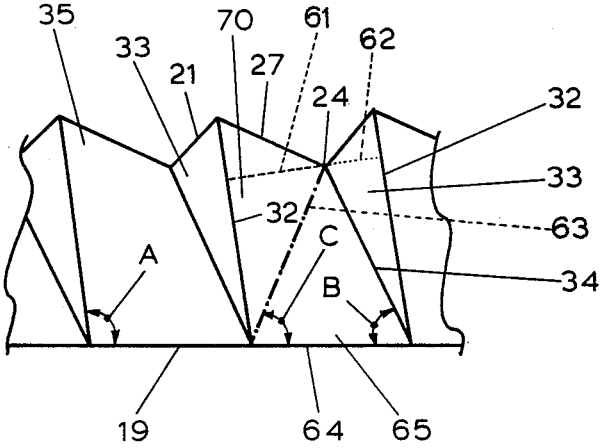

In the case of a cylinder, square, or polygon shaped container without draft, edges 32 will be parallel to each other, around the container after the blank is assembled and before the top is folded, except again in the case where the slanted external folds of FIG. 12 are desired.

Internal folds 34 are formed in the container 16 at acute angle to the external folds 32 and extend from each point 24 on line 20 to the intersection of the external folds 32 with the rim 19 and have their apex toward what will be the inside of the container. These internal folds will appear as indented folds when viewed from the outside of the container.

Triangular shaped tucked panels 33 are defined by external fold 32, the adjacent internal fold 34 and a falling edge 21. The four sided exposed panels 35 are defined by external fold 32, the adjacent internal fold 34, and rim 19, and rising edge 27. Side 14 intersects the top edge 20 along a rising edge 27 and side 15 intersects the top edge 20 at point 24 or anywhere on rising edge 27 away from the internal fold 34. The bonding area 40 lies between the side 15 and the virtual line 42 and the bonding area 41 on the opposite side of the blank lies between the side 14 and the virtual line 43.

To form the container 16, side 15 is brought around to virtual line 43 so that the bonding areas 40 and 41 overlap and a generally tubular body is formed. An adhesive or other means for securing the sides 14 and 15 in this position is applied to the bonding areas 40 and 41. The bonding areas must preferably not interfere with or contain any fold line other than the rim fold 19. When the container 16 is open, the sides 14 and 15 and the external folds 32 are in the plane containing the axis of the generally tubular body of the container, except in cases where a slanted external fold 32 is desired. Cylinders, polygons and cones will follow similarly.

Figure 5:
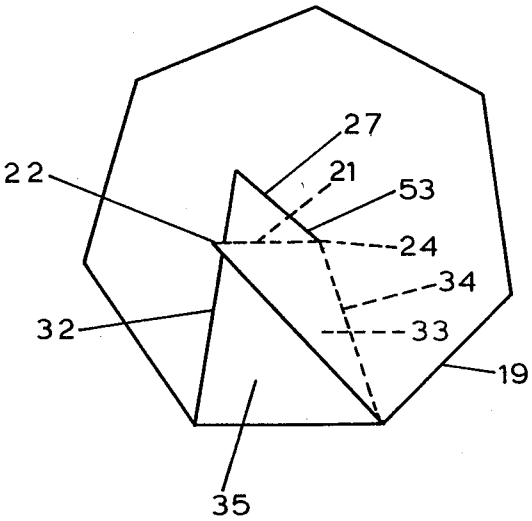
FIG. 5 is a top view of the container of FIG. 5 illustrating a single set of adjacent, overlapping panels.
Figure 4:
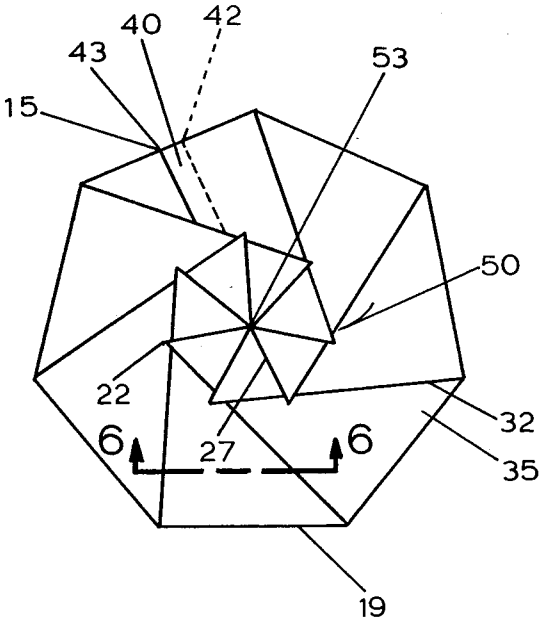
FIG. 4 is a top view of the present invention.

To close the container 16, the top edge 20 of the container 16 is gently pushed downward and simultaneously rotated in a single motion. The tucked panels 33 will be folded under the exposed panels 35 along the external and internal folds 32 and 34 respectively. The exposed panels 35 will overlap one another and entirely cover the tucked panels 33 as shown in (FIG. 4 and FIG. 5). The external folds 32 and rising edges 27 will form a rosette 50 around the center of the closed container 16 as seen in FIG. 4. The external folds 32 are tangential to the rosette 50 and the rising edges 27 are generally radial to the rosette 50 when the container 16 is closed (FIGS. 4 and 5.) The point at which the rising edges 27 meet forms the center 53 of the rosette, the rising edges 27 of the exposed panels 35 press against one another to effectively seal the top of the container 16.

THEORY

FIG. 10–13 illustrate the theory of my invention when considered with FIGS. 1–6. The top of the container previously described is designed to lock into place rather than merely fold closed. This is accomplished by varying the sizes of the panels, tucked and exposed, which make up the top. I have found two equivalent methods to accomplish this. Both of these methods involve manipulation of the external and internal folds from what would be a 'normal' fold which would complete the area of the top of the container, as shown in "idealized" FIG. 10.

Figure 10:
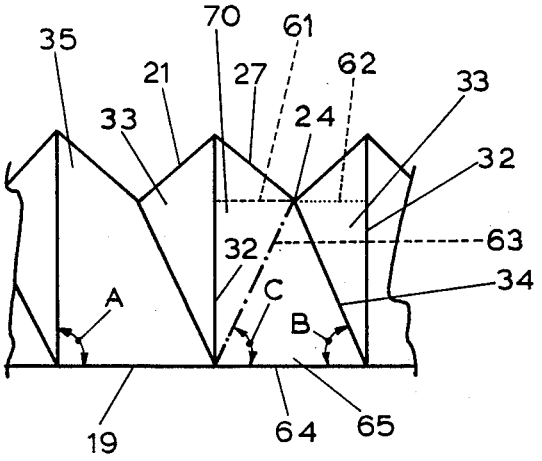
FIG. 10 is a plan view of the top section of a non-locking container.

Consider the structure shown in FIG. 10 in which the blank 16 created to form the container has an arc 19 which will become the rim of the finished container when the sides of the blank 16 are secured together. Erected on this arc are a series of implied isoceles triangles 65 formed by fold 34, fold 64 and the implied line 63. These triangles 65 have a height equal to the radius of the container 16 from the rim 19 to the axis point 24. The rim 19 can be thought of as a series of straight line segments 64, each of which is the base of an isoceles triangles 65. In FIG. 10, the triangle 65 is isosceles in that the base angles B and C are equal to each other and sides 34 and implied line 63 are equal to each other. In FIG. 10, each fold line 32 bisects the angles between the adjacent sides 63 and 34 of two respective isosceles triangles 65. Each external fold line is the same length and each internal fold line is the same length. Free edge 27 is equal to free edge 21. An implied triangle 70 is formed from the external fold line 32, the rising edge 27, and the implied line 63. Virtual line 61 is the height of triangle 70, and is equal to the height 62 of triangle 33 because the triangles 70 and 33 are mirror images of each other. Because each triangle 70 shares its base 32 with a triangle 33, when the panel 35 is folded on top of panel 33, triangle 33 fits exactly beneath implied triangle 70.

Because the height of each isosceles triangle 65 is equal to the radius of the top of container 16, if the fold lines 32 are folded to form external folds and if fold lines 34 are folded to form internal folds, the set of isoceles triangles 65 will completely fill the opened top of the container 16 and the panel 35 will be folded on top of the panel 33. In the process, because the fold lines 64 at the base of the isosceles triangle 65 must be a substantially straight line, the rim 19 will become polygonal in shape, having sides 64 as its rim. Of course, this process could be facilitated by having fold lines 32 extend to the base of the container so that the container itself is polygonal or box shaped rather than circular, but that is not essential, because when the top is folded, the rim will become polygonal whether or not fold lines are provided extending down the sides of container 16.

Such a container will not lock or unlock in the manner of my invention, however, it is necessary to understand the geometry involved in order to understand the modifications that make my invention work.

Figure 6:
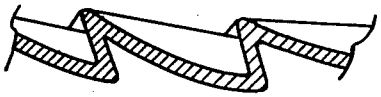
FIG. 6 is a cross section view of the top of the container along line 6—6 of FIG. 4.

By slightly changing the geometry of the external folds, the internal folds, or both, the area taken up by the triangles previously mentioned will create tension and compression on said panels. This will in effect create a 'jamming' or 'spring' effect between these panels when the top is folded toward the plane of the rim of the container. Once past the plane of the rim, these panels will in effect be 'jammed' into a locked position, against the overlapped parts that form the rosette, and are still pulled downward, thereby creating a resistance to reopening. FIG. 4 shows a top view of the container showing the rosette 50 which forms at the center of the closed container. FIG. 5 shows an isolated view of two of these folds and their relationship to each other and to the center axis 53 of the container. FIG. 6 shows a cross-sectional view as delineated in FIG. 4 looking from the outside of the container toward the center, illustrating the panels in tension and compression.

Figure 11:
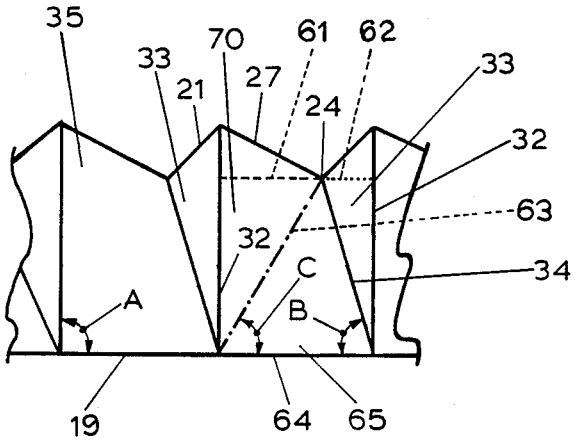
FIGS. 11–13 are a plan view of the top section of a blank illustrating exaggerated angles exaggerated for clarity.

One such change in geometry is shown in FIG. 11. Angle B is increased very slightly which has the effect of reducing the height 62 of triangle 33. As in FIG. 10, in FIG. 11 the external fold line 32 remains at substantially a right angle to the rim 19. Because of the reduction of the height of triangle 33, it becomes insufficient to complete the fold necessary in the normal top fold described previously as to FIG. 10. A 'spring' action is created when the folding top is near the plane of the rim of the container. When the top is being folded, internal fold 34, in effect, moves away from the external fold 32 while the height of triangle 33 is also reduced. Quadrilateral panel 35 is put into compression due to the pull exerted on external fold 32 by the reduction in height of triangle 33 and the movement of internal fold 34 away from it. When folded panels 35 and 33 are pushed below the plane of the rim 19 of the container as shown in FIG. 6, the forces of compression on the exposed panels 35 and the forces of tension on the tucked panels 33 are great enough to resiliently lock the top of the container 16. With this system, the point of contact between the panels when the container is folded will lie near a point where a line bisecting line 64 at a right angle reaches rising line 27. This is best shown in FIG. 5 as point 53.

Another way of achieving a locking configuration is shown in FIG. 12. In the case of a locking top where slanted external folds are desired, the external folds will not be part of the radii, but will be inclined to such radii in the same direction and at the same angle to the respective radii they replace. As shown in FIG. 10, the triangle 65 in FIG. 12 is isoceles so that angles B and implied angle C are equal to each other and the implied side 63 and internal fold line 34 are equal to each other. The height of the isoceles triangle is equal to the radius of the polygon forming the closed top of the container. By increasing angle A, thereby creating a slanted external fold, we are creating the same effect on the tucked and exposed panels as mentioned in the prior method. When the top is being folded and is near the plane of the rim of the container, external fold 32 in effect moves away from the internal fold 34 while the height of the connecting triangle 33 has been reduced. When folded panels 35 and 33 are pushed below the plane of the rim 19 of the container 16, the forces of compression on the exposed panel 35 and the forces of tension on the tucked panels 33 creates a jamming effect. Once past the plane of the rim, the tension and compression diminish slightly, thereby creating a resistance to reopening. At the same time, the overlapping panel ends rest on underlying panels to form the rosette and limit panel motion, although they remain capable of further motion due to resilience of the material.

Figure 13:
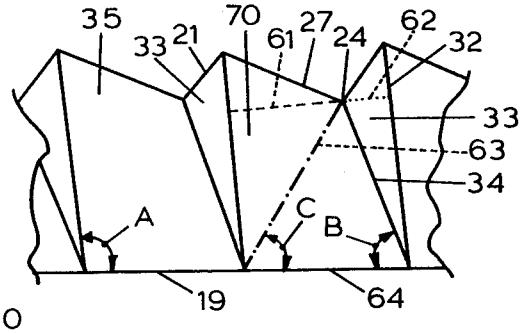

It is possible to utilize both methods simultaneously, by using the increased angle B from the first system and an increased angle A from the second system as shown in FIG. 13. In such a system, the amount of angle increase for each fold must be reduced from what would normally be utilized when using just one system or the other. It should also be noted that the amount of the increase in the angles in any of these systems must be sufficient to create a locking top, but not so great as to put such stress on the material of the container that the folds tear. The angles shown in FIGS. 11–13 have been exaggerated for the purpose of visibility. The exact angle may vary with the material and the number of panels.

Also, in using any of the systems described, the height of the implied isoceles triangle dictated by the angle of the internal fold 34 must be the same or of greater length than the length of the radius of the polygon formed on the top of the container 16 by the fold lines.

The locking action of the top is due to the fact that the tension and compression on the respective panels making up the top surface are acting in a direction toward the respective fold lines against which the force is exerted. When the top which is being folded and closed is pushed below the plane of the polygon forming the rim of the container, the tension on the smaller panel is exerted in a direction to cause further closing of the top. The upper edge 20 comprised of lines 21 and 27 between apex 24 of the internal fold 34 also containing the external folds 32 can be of a variety of shapes or can be notched to facilitate a center opening when the top is locked. The shape of this upper rim is dictated by the design desired. However, having a longer external fold as shown best in FIG. 3, has the effect of helping to limit the amount of downward travel the panels will reach when completely folded. They thus limit downward movement of the top panels and provide a secure stopping point for the motion.

Figure 18:
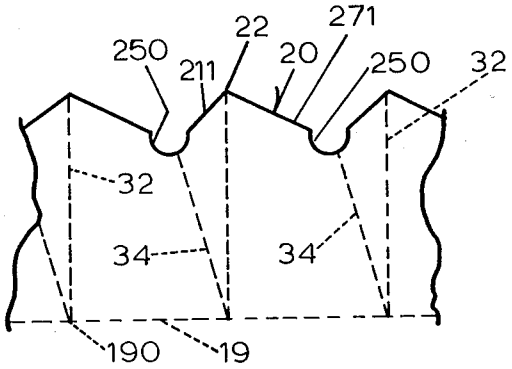
Figure 15:
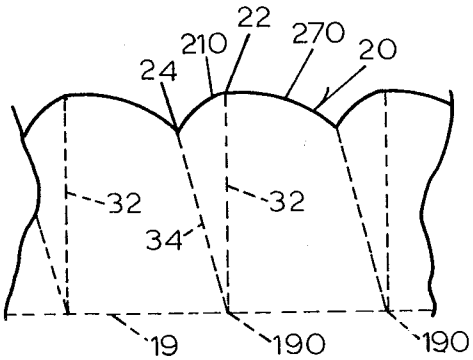
Figure 17:
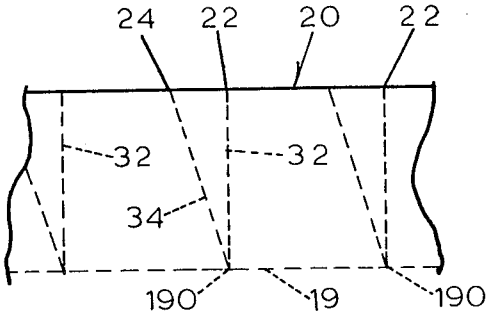

If the reason for this locking action is considered, it may be seen that the locking action has a rather unusual feature. It might be supposed that the action is due to the interference of the larger panels as they reach the center of axis 53 of the container 16, but that is not the case. If the panels are cut away as shown in FIG. 18 in such a way that no panel even approaches the center of the container, so that there is a hole at the center 53 when the top of the container is completely folded into the closed position with the rosette around the top, the container still snaps closed despite the fact the panels are not touching. This feature might be useful where for some reason it is desirable to close the container about a center post, such as a straw or other tube which could withdraw the contents of its container. This could be a drinking straw, the paint supply tube of a paint sprayer, or the like. The locking position of the top panels does not in any way depend on the presence or absence of the center tube, but is determined by the geometry of the panels themselves.

However, as described above, the larger panel 35 preferably will have a point that will contact the other panels. Using either method of resilient locking, the container will snap completely closed and will remain so until the user pulls upwardly on a fold of the pleated top, whereupon the container will pop open again. If it is desired to withdraw liquid from the container, for instance to drink from the cup, it is only necessary to push a straw through the folded top at the center axis 53 of the container. The panels will yield slightly to allow the straw to enter and will close about the straw because of the tension on the lower panels and the compression on the upper panels, so that a tight seal is maintained even though the straw has been inserted. Thus, the user can drink from the container without spilling the contents.

It will also be understood that although the preferred form of the invention is a complete container formed from a single blank 16 for the sides and top with a conventional bottom, it would be possible to form the container top of my invention from a separate piece of the same or different material than the remainder of the container and to secure it to the container by any standard means. The number of times the container is reusable would depend on the resistance of the material to tearing at the folds. In the case of metal, the folds would be likely to fatigue very quickly, whereas some plastics would endure for long periods of time. Various types of paper and coated paper would be intermediate in their performance.

It should also be noted that both of the above described methods of causing tension and compression on the surface area of the folding panels of the top may be reversed in direction so that, for instance, the left hand panel becomes the shorter panel rather than the right hand panel of the pair. The effect of such a change is merely to reverse the direction in which the external folds swing away from the radius of the container as the top is closed so that although the pleats fold down as previously described, when the other panel is the larger panel, they would fold in a counterclockwise direction with the shorter panel underneath to achieve the same locked position. FIGS. 11–13, and the other figures, would then be mirror images of the forms shown.

Looking again at FIGS. 1, 2, 3 and 4, it should be noted that the location of side 15 relative to the top edge 20 is preferably chosen such that when closed, the portion of side 15 above the rim 19 defines a radius of the rosette 50 shown in FIG. 4 and has no part which intersects internal fold 34. This helps insure proper folding during closing of the container 16 and helps maintain and support the seal of the bonding area 40.

In FIG. 4 the configuration of the rosette 50 is such that a drinking straw or tube or the like (not shown) of sufficient stiffness may be inserted through the center 53 of the rosette 50. The rising edges 27 of the exposed panels 35 will be displaced by such insertion forming a seal around the straw and thereby maintaining the seal at the top of the container 16.

DISCUSSION OF PRIOR ART

Figure 19:
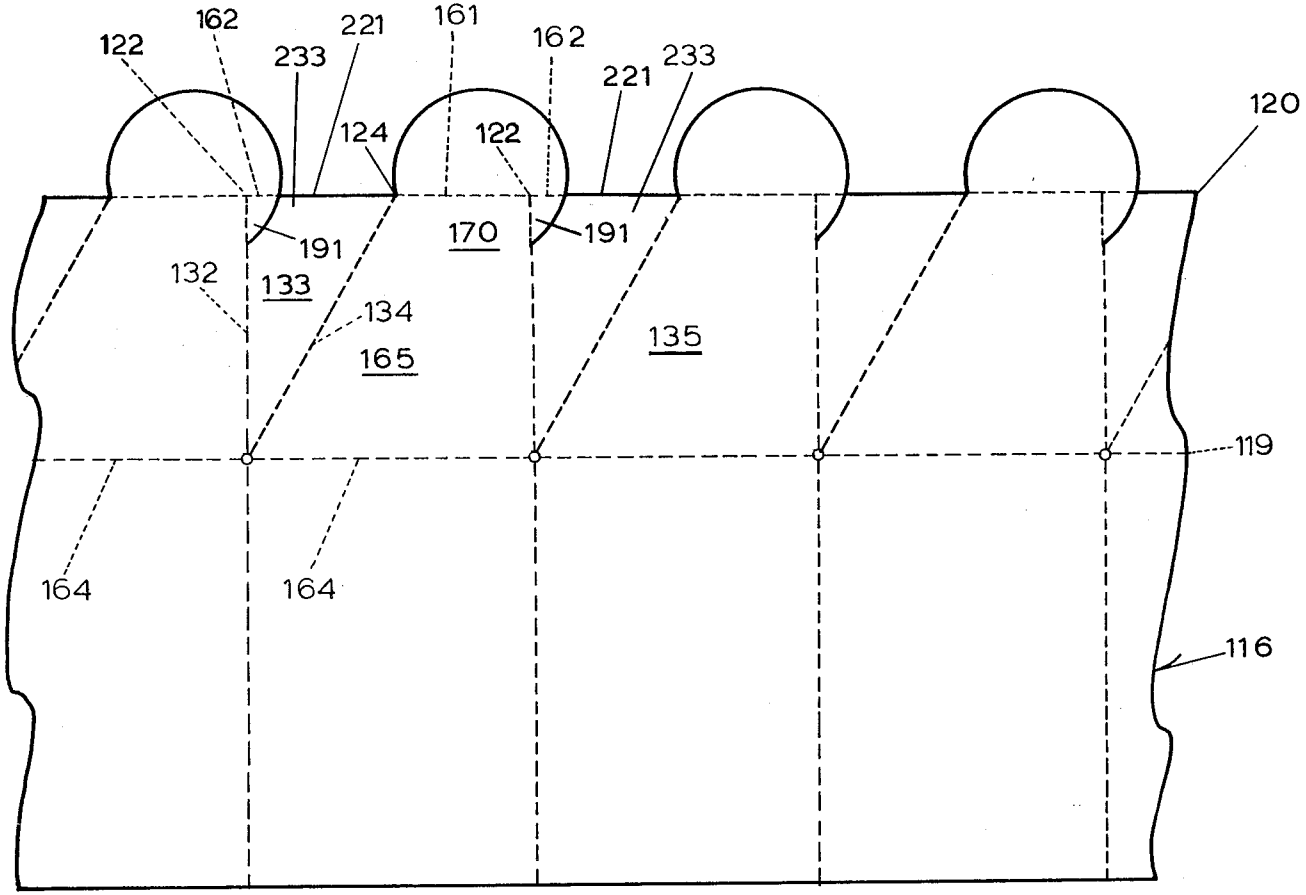
FIG. 19 is a broken away plan view of four panels of a blank of a prior art carton, omitting bottom closure flaps.

In FIG. 19 it can be seen how the present invention improves on prior art. FIG. 19 shows a plan view of three panels of a blank 116 of a prior art carton, omitting bottom closure flaps. The blank 116 has a rim 119 and a straight upper edge 120 which is interrupted by a series of semicircular projections 190. The blank 116 also has a series of external folds 132 and internal folds 134. By drawing an implied line 163 from the point where the external fold 132 meets the rim 119 to the point 124 where the semicircular projection 190 meets the upper edge 120, an implied isoceles triangle 165 having a base 164 and two equal sides 134 and 163 is shown. This triangle 165 is analogous to the triangle 65 of FIG. 10. Two more implied triangles in FIG. 19 are the implied right triangles 133 and 170. The implied triangle 133 is formed by extending the external fold line 132 until it meets the upper edge 120 at the point 122, by the implied line 162 which extends the top edge 221 of the tucked panel 233 to point 122, and by the internal fold 134.

The implied triangle 170 is formed by extending the external fold line 132 until it meets the upper edge 120 at the point 122, by the implied line 161 from point 122 to the point 124, and by the implied line 163. As can be seen the implied triangles 133 and 170 have equal heights (162 plus 221) and 161 respectively and are mirror images of each other. Therefore, when the exposed panel 135 is folded on top of the tucked panel 233, the implied triangle 133 minus the small portion 191 cut away to form part of the circular projection 190 fits beneath the implied triangle 170 without the exposed panel 135 being put under compression or the tucked panel 233 being put under tension. As was the case in FIG. 10, the prior art container 116 does not lock when its panels 135 and 233 are folded together and pushed downwardly. (It would also be noted that although the prior art blank 116 closes counter-clockwise while the configurations in FIG. 10, FIG. 11, and FIG. 12, & FIG. 13 close in a clockwise direction, the direction of closing is immaterial in the present invention, i.e. the configurations in FIG. 10, FIG. 11, FIG. 12 and FIG. 13 could have been shown closing in a counter-clockwise direction).

ADDITIONAL EMBODIMENTS OF THE INVENTION

Figure 7:
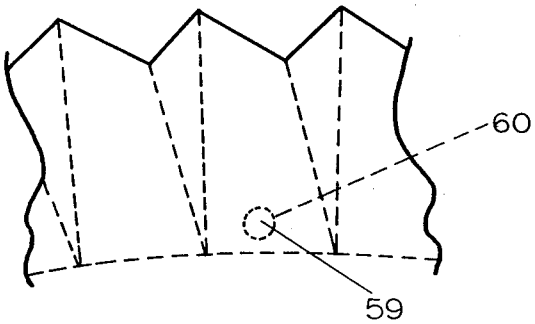
FIGS. 7–9 are fragmentary plan views of a portion of a blank showing alternatively configured perforations for an opening in the top thereof.

As shown in FIG. 7, a circular perforation 60 may be provided in the top of the container 16 between two adjacent external folds 32. The circle 59 in the top of those containers, thereby forms an opening through which a straw may be inserted.

Figure 8:
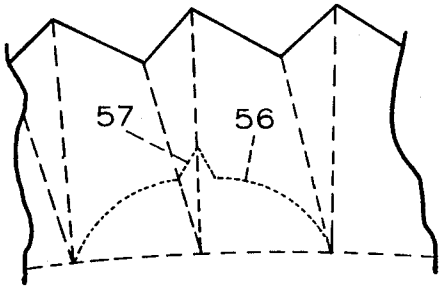

FIG. 8 shows a different variation of this portion of the invention wherein a generally arcuate perforation 56 has an angular pointed portion 57 where the perforation 56 crosses an external fold 32. When the container 16 is closed, this pointed portion 57 serves to facilitate gripping the portion of the top of the container 16 defined by the perforation 56, which may be pulled outwardly to create an opening for pouring or drinking the contents of the container.

Figure 9:
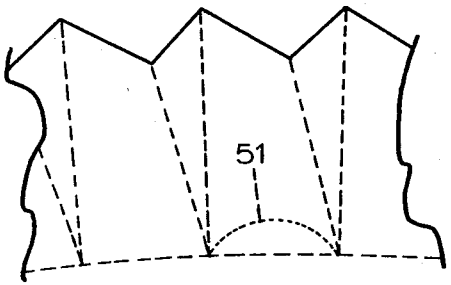

FIG. 9 shows another variation of this portion of the invention in which an arcuate perforation 51 is provided in the top of the container 16 between two adjacent external folds 32 and adjacent to the rim 19. The portion at the top of the container 16 defined by the perforation 51 may be pushed into the container thereby forming an opening for pouring or drinking the contents of the container.

No drawings have been shown for the bottom of the container except to the extent a cylindrical (FIG. 14) or frusto-conical (FIGS. 1–3) container is illustrated, in which case a circular bottom is appropriate. The precise manner in which the bottom is secured to the blank, however, is known to those skilled in the art, and as such, does not form a part of the present invention. The nature of the bottom will in some cases depend on the contents or use of the container. The sides of the blank may be extended so that a cone results, needing no bottom. Flaps may be provided in the case of a box or polygon shaped container. In its most evident configuration, a conventional cup bottom may be glued or otherwise secured.

Figure 14:
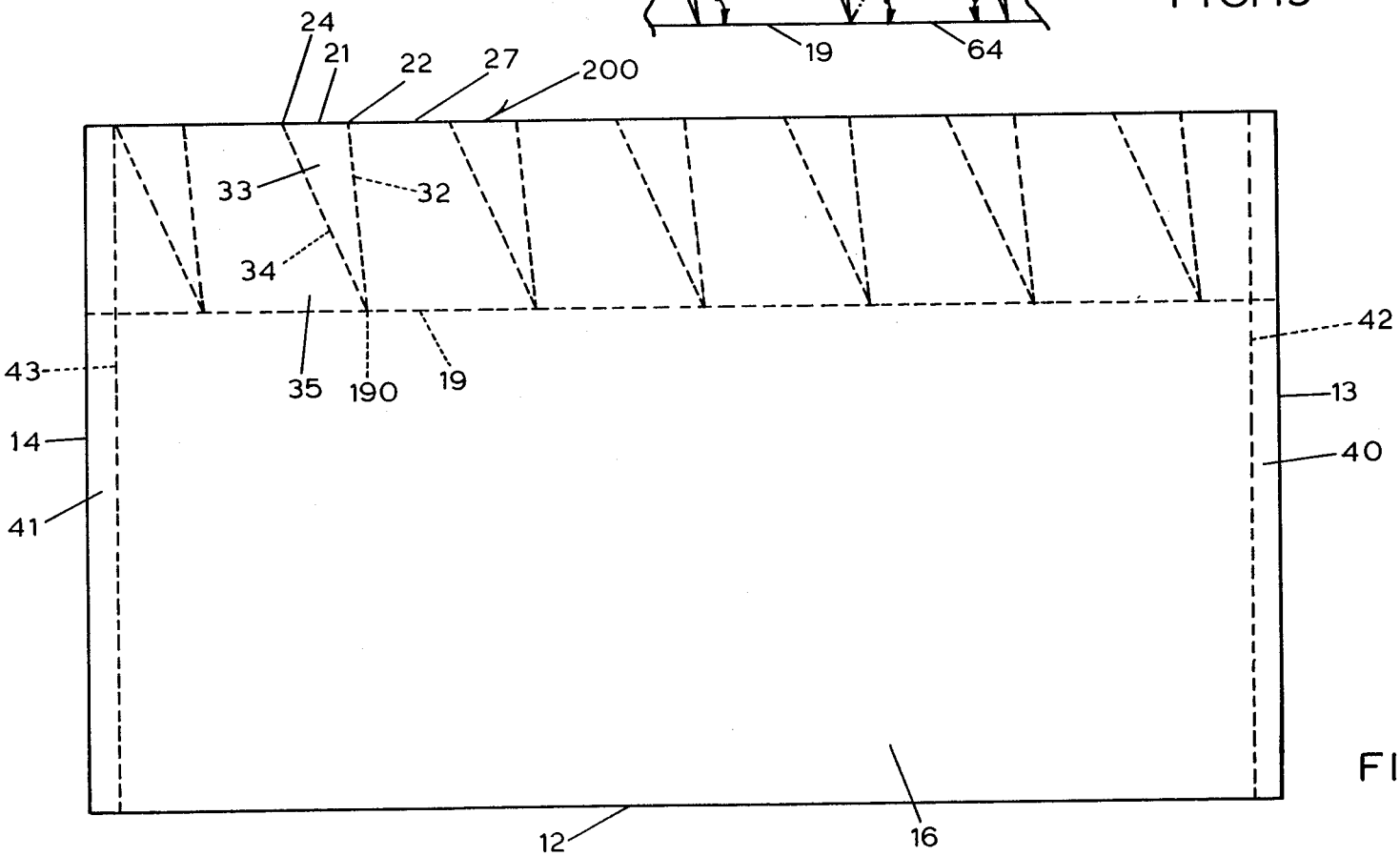
FIG. 14 shows a plan view of a blank for forming a self-locking container.
Figure 16:
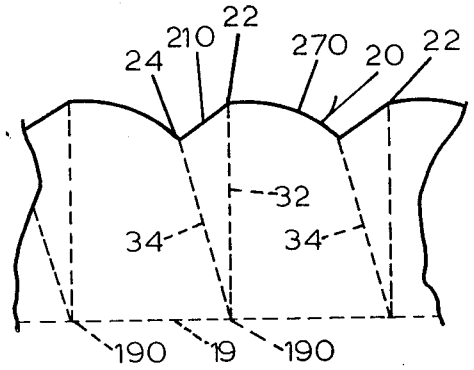
FIGS. 15–18 illustrate alternately configured for the top edge portion of a container.

FIG. 14 shows a rectangular blank with a straight top edge 200. When bonding areas 40–41 are overlapped the result is a cylinder, or if folds extend from rim 19 to bottom 12 along parallel lines, from the point 190 where fold lines 32 and 34 meet rim 19, to bottom 12, the container will be polygon shaped.

FIGS. 15–18 show further variations in edge form. Since locking does not depend on edge shape, many variations are possible. FIG. 18 shows a form that leaves an opening at axis 53 when the top is in locked position.

I claim:

1. A self-locking container made from stiff, resiliently foldable material, comprising:

a cup-shaped body having a polygonal rim defining the upper boundary thereof, said body having a circular cross-section along a substantial length thereof;

locking means, contiguous with said body and extending from said rim to a free edge, for closing the upper portion of said container;

said locking means comprising a continuous flap having a plurality of contiguous alternating exposed and tucked panels, there being a plurality of alternately disposed internal and external folds disposed therebetween, respective tucked panels being folded underneath respective exposed panels when said locking means is in a closed position;

each of said exposed panels and said tucked panels being bounded by one of said external folds, one of said internal folds, and said free edge, said exposed and tucked panels being substantially free of circumferential stresses when said locking means is in said open position; and said exposed panels being placed in compression and said tucked panels being placed in tension when said locking means is in said closed position.

2. The container of claim 1 wherein said body is generally cylindrical.

3. The container of claim 1 wherein said body is generally frustoconical in shape.

4. A blank for forming a self-locking container made from a stiff, resiliently deformable material, comprising:

a sidewall panel;

a rim fold line generally defining the upper boundary of said sidewall panel and spanning the transverse direction of said blank, said transverse direction of said blank being generally normal to the longitudinal axis of said container;

a top panel extending from said rim fold line to a free edge of said blank, said top panel comprising a plurality of equally spaced outward fold lines generally normal to said rim fold line, said outward fold lines extending from said rim fold line to said free edge and forming a series of generally rectangular panels therebetween;

each of said rectangular panels comprising a quadrilateral panel and a triangular panel having an inward fold line for forming an inward fold therebetween, said inward fold line forming an acute angle with said outward fold line at said rim fold line and terminating at said free edge at a junction;

said inward fold line defining a first equal side of an implied isosceles triangle, the base of which comprises that portion of said rim fold line spanning adjacent outward fold lines when said blank is formed into said container, the height of said implied isosceles triangle being the distance from the midpoint of said base to the apex of said implied isosceles triangle;

the radius of said container being defined as the distance from the longitudinal axis thereof to said midpoint of said base when said blank is formed into said container;

wherein said height of said implied isosceles triangle is greater than said radius, and the distance between said midpoint of said base and said junction is less than said radius.

5. The blank of claim 4 wherein said junction is generally arcuate.

6. A blank for forming a self-locking container, comprising a flat panel of stiff resiliently foldable material having a top edge;

a bottom edge;

a pair of side edges of complimentary shape such that, upon folding of said blank, said side edges mate along substantially the entire length thereof;

an inwardly directed rim fold line spanning said side edges, which rim fold line being geometrically similar to said bottom edge, the portion of said panel spanning said bottom edge and said rim fold line being free of fold lines;

a first series of equally spaced, parallel fold lines spanning said rim fold line and said top edge, and a second series of equally spaced parallel fold lines spanning said rim fold line and said top edge and positioned in alternating series with said first fold lines to define a series of panels which, upon assembly of said blanks into a container, can be folded inwardly and locked in a mutually overlapping relationship to releasably close said container.

7. A self-locking container, comprising:

a sidewall having a circular cross-section along a substantial portion of its length;

a substantially circular bottom wall united with said sidewall at a lower end portion of said sidewall; and a folding closure integral with an upper end portion of said sidewall, said closure comprising an endless flap having a series of alternating spaced inward folds and outward folds, said folds disposed to define a series of panels which can be folded inwardly in a mutually overlapping relationship to releasably close said container.

8. The container of claim 7 wherein said sidewall is generally frusto-conical.

9. The container of claim 7 wherein said sidewall is generally cylindrical.

* * * * *